United States Patent [19]

Kehrer et al.

[11] Patent Number: 4,537,793

[45] Date of Patent: Aug. 27, 1985

[54] METHOD FOR GENERATING HARD, WEAR-PROOF SURFACE LAYERS ON A METALLIC MATERIAL

[75] Inventors: Hans-Peter Kehrer, Pforzheim; Jüergen Villain, Unterhaching; Werner Reiff, Baldham, all of Fed. Rep. of Germany

[73] Assignee: Siemens Aktiengesellschaft, Berlin and Munich, Fed. Rep. of Germany

[21] Appl. No.: 501,287

[22] Filed: Jun. 6, 1983

[30] Foreign Application Priority Data

Jul. 2, 1982 [DE] Fed. Rep. of Germany ..... 3224810

[51] Int. Cl.[3] ..... C23C 3/04

[52] U.S. Cl. ..... 427/35; 427/49; 427/53.1

[58] Field of Search ..... 427/383.9, 35, 53.1, 427/253, 49; 219/121 L

[56] References Cited

U.S. PATENT DOCUMENTS

| | | | |
|---|---|---|---|
| 3,508,977 | 4/1970 | Basche | 427/253 |
| 3,936,327 | 2/1976 | Fichtl | 427/253 |
| 4,126,488 | 11/1978 | Kunst et al. | 427/253 |
| 4,229,232 | 10/1980 | Kirkpatrick | 219/121 L |
| 4,321,073 | 3/1982 | Blair | 727/253 |

FOREIGN PATENT DOCUMENTS 2437831 7/1981 Fed. Rep. of Germany .

OTHER PUBLICATIONS

Technologie der Wärmebehandlung von Stahl (Technology for Thermal Treatment of Steel), Ed. by Dr. Hans-Joachim Eckstein, (1976), pp. 161-170.

*Primary Examiner*—John H. Newsome

*Attorney, Agent, or Firm*—Hill, Van Santen, Steadman & Simpson

[57] ABSTRACT

Hard, wear-proof surfaces are produced on a metallic material, such as a ferrous material, by applying a decomposable compound containing an element capable of hardening metallic materials, in the form of a powder, a paste-like admixture or a liquid, onto surfaces to be hardened, and applying an energy surge, obtained from, for example, a laser beam or an electron beam, to the surfaces containing such coating so as to decompose the coating and release the element which diffuses into the surface to be hardened. With this process, the base material is not subjected to any meaningful thermal loads and is not altered in term of its mechanical and physical properties.

7 Claims, 1 Drawing Figure

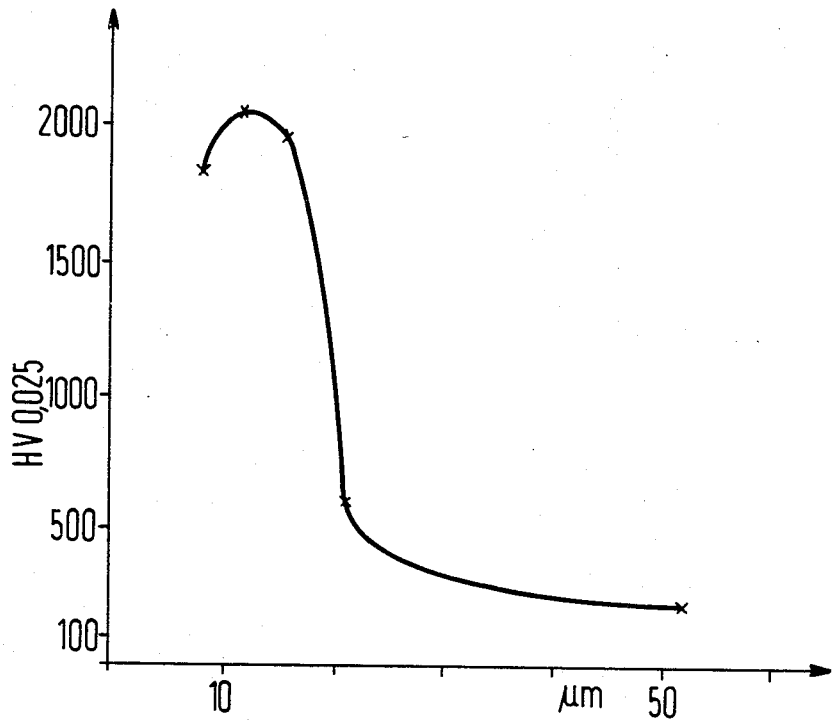
2000
1500
1000
500
100
HV 0,025
10
µm
50

METHOD FOR GENERATING HARD, WEAR-PROOF SURFACE LAYERS ON A METALLIC MATERIAL

BACKGROUND OF THE INVENTION

1. Field of the Invention

The invention relates to hard, wear-proof surfaces on a metallic material and somewhat more particularly to a method of generating such surfaces without altering the mechanical or physical properties of the base material.

2. Prior Art

Anti-wear layers are being increasingly employed for improving the wear behavior of, for example, working surfaces of tools, structural parts and function units. A multitude of layers, which can be industrially applied and which exhibit different properties, depending upon manufacturing conditions, are available for this purpose.

Hard, wear-proof surface layers can be produced with tradional thermal and/or thermo-chemical techniques (for example, boronation, carburization, nitridation, etc). Thermal techniques generally involve heating a ferrous material to temperatures in the austenite range (about 850° to 950° C.) with a subsequent, rapid quenching. Thermo-chemical techniques involve decomposing, as by the application of heat, compounds of boron, nitrogen or carbon at a surface of a part to be hardened and allowing the so-released element to diffuse into this surface.

A disadvantage resulting from using thermal techniques is that a hardenable, heat-resistant material is required or, with thermo-chemical techniques, a disadvantage is that the relatively high temperatures and long process times required can cause a negative influence on the base material so that satisfactory use properties are not obtained for the overall system. A partial hardening is not possible with these known techniques.

SUMMARY OF THE INVENTION

The invention provides a method which enables production of hard, wear-proof surfaces or surface layers in a very short time period.

By following the principles of the invention, the base material typically experiences no thermal load and is not altered in terms of its inherent mechanical and physical properties.

In accordance with the principles of the invention, a decomposable compound containing an element capable of hardening metallic materials, is applied to a surface to be hardened and an energy surge is applied to such surface so as to decompose the compound and release the hardening element which diffuses into the surface to be hardened and penetrates a certain distance or thickness to produce a layer which is chemically different from the underlying base material.

A significant advantage of the invention is that workpieces can be surface-hardened in very restricted areas. Further, in-diffusion with the inventive techniques occurs in a relatively short time period because an accelerated surface diffusion occurs. Cooling occurs by heat dissipation into the workpiece undergoing treatment. A surface layer which differs in terms of structure and formation (form of compound) from known diffusion layers is generated in this manner.

In preferred embodiments of the invention, decomposable compounds of boron or nitrogen or mixtures thereof, in the form of a powder, a paste-like admixture or a liquid, are utilized so that, respectively, boron or nitrogen diffuses into a select surface area of a given workpiece, for example comprised of iron or the like.

It is, indeed, already known to diffuse boron, carbon and nitrogen into surfaces of metallic workpieces with known thermo-chemical techniques. However, with these known techniques, a substantially longer process is required because the surface reactions occurs or sequences slower due to the amount of energy provided. Moreover, states of equilibrium are formed with the known thermo-chemical techniques. However, the inventive technique is based on the fact that a state of disequilibrium is produced at the surface undergoing treatment.

In accordance with the principles of the invention, the applied energy surge is obtained from an energy source selected from the group consisting of laser beams, electron beams or a brief, relatively intense electrical current. It is only with the assistance of these energy sources that a partial hardening, within relatively short time periods becomes possible at all with the thermo-chemical techniques of producing hard, wear-proof surfaces on metallic workpieces.

BRIEF DESCRIPTION OF THE DRAWINGS

The FIGURE is a graphical illustration showing the hardness of a surface layer on a laser-boronated workpiece of a dynamo sheet produced in accordance with the principles of the invention.

DESCRIPTION OF PREFERRED EMBODIMENTS

A dynamo steel sheet was coated with a decomposable boron compound and a laser beam was irradiated in short surges against select areas thereof, which were then examined and tested for surface characteristics, including measurement of the thickness of the resultant, chemically different surface layer and the hardness thereof.

In the drawing, the thickness of the generated wear-resistant or wear-proof surface areas from the above specimen is entered along the abscissa in $\mu$m units while the hardness thereof, in Vickers hardness (HV) with a test load of 25 p (HV 0.025) is entered along the ordinate.

As can be clearly seen from the illustrated curve, which extends through five measuring points, the hardness, in the exemplary embodiment, quickly decreased after the generated surface layer thickness exceeded about 20 $\mu$m. However, hardened surface layer thicknesses extending up to about 20 $\mu$m are entirely sufficient in practice for improving the wear behavior of, for example, work surfaces of function parts and tools formed from metallic materials, such as a ferrous material. Structures and phases of higher degree of hardness were noted at the treated surface areas. As shown in the curve, a hardness of approximately 2000 HV 0.025 existed in the treated surface layer with the exemplary embodiment. The presence of iron boride, $Fe_2B$, was radiographically established.

In accordance with the principles of the invention, hard, wear-proof or wear-resistant surface layers are produced on a metallic material, such as a ferrous material, by applying a suitably decomposable compound containing an element capable of hardening metallic materials onto a select metallic surface to be hardened and applying a sufficient energy surge to at least the surface area containing the compound so as to decompose the compound and release the element which diffuses into the surface to be hardened. In preferred embodiments of the invention, the compound applied to the metallic surfaces contains an element selected from the group consisting of boron, nitrogen and mixtures thereof. In preferred embodiments of the invention, the generated surface layer has a thickness of up to about 20 μm and has a hardness, in Vickers, of up to about 2000 HV 0.025.

As is apparent from the foregoing specification, the present invention is susceptible of being embodied with various alterations and modifications which may differ particularly from those that have been described in the precedings specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

We claim as our invention:

1. A method for producing hard, wear-proof surface layers on a metallic material, comprising:

applying a decomposable compound containing an element capable of hardening metallic material onto a metallic material surface to be hardened; and applying an energy surge to at least the surface areas containing said compound so as to decompose said compound and release said element which diffuses into the surface to be hardened, thereby producing a surface layer having a chemical composition different from that of said metallic material;

said applyings being carried out so that said surface layer has a thickness up to about 20 μm.

2. A method for producing hard, wear-proof surface layers as defined in claim 1 wherein said compound contains an element selected from the group consisting of boron, nitrogen and mixtures thereof.

3. A method for producing hard, wear-proof surface layers as defined in claim 1 wherein said energy surge is obtained from an energy source selected from the group consisting of a laser beam, an electron beam and a brief, relatively intense electrical current.

4. A method for producing hard, wear-proof surface layers as defined in claim 1 wherein said metallic material is a ferrous material.

5. A method for producing hard, wear-proof surface layers as defined in claim 1 wherein said surface layer has a hardness, in Vickers, of up to about 2000 HV 0.025.

6. A method for producing hard, wear-proof surface layers as defined in claim 1 wherein said metallic material is ferrous and said surface layer includes $Fe_2B$.

7. A method for producing hard, wear-proof surface layers as defined in claim 1 wherein said compound applied to the surface to be hardened is in a form selected from the group consisting of a powder, a paste-like admixture and a liquid.

* * * * *